US005852847A

United States Patent [19]

Weiss et al.

[11] Patent Number: 5,852,847

[45] Date of Patent: Dec. 29, 1998

[54] HIGH-SPEED PICK-UP HEAD FOR A STREET SWEEPER

[75] Inventors: Christopher R. Weiss, St. Charles; Robert A. Jajko, Villa Park; Larry D. Granderson, Sr.; Norman L. Todd, both of Elgin, all of Ill.

[73] Assignee: Elgin Sweeper Company, Elgin, Ill.

[21] Appl. No.: 805,076

[22] Filed: Feb. 21, 1997

[51] Int. Cl.[6] ..... E01H 1/08

[52] U.S. Cl. ..... 15/346; 15/340.1; 15/347

[58] Field of Search ..... 15/345, 346, 340.1

[56] References Cited

U.S. PATENT DOCUMENTS

| | | | |
|---|---|---|---|
| 3,512,206 | 5/1970 | Young | 15/346 |
| 3,545,181 | 12/1970 | Young | 55/432 |
| 3,755,851 | 9/1973 | Williams | 15/346 |
| 3,886,623 | 6/1975 | Landesman et al. | 15/319 |
| 4,109,341 | 8/1978 | Larsen et al. | 15/346 |
| 4,160,302 | 7/1979 | Hirst et al. | 15/340 |
| 4,171,551 | 10/1979 | Hildebrand et al. | 15/84 |
| 4,204,849 | 5/1980 | Johnston | 55/310 |
| 4,236,871 | 12/1980 | Hirst et al. | 416/186 |
| 4,347,018 | 8/1982 | Wrightson et al. | 405/150 |
| 4,359,801 | 11/1982 | Tate | 15/346 |
| 4,466,156 | 8/1984 | Blehert | 15/346 |
| 4,660,248 | 4/1987 | Young | 15/340 |
| 4,691,402 | 9/1987 | Veselka | 15/87 |
| 4,773,117 | 9/1988 | Duthie et al. | 15/340 |
| 4,773,121 | 9/1988 | Young | 15/346 |
| 4,779,303 | 10/1988 | Duthie et al. . | |
| 4,807,327 | 2/1989 | Jajko et al. . | |
| 4,885,817 | 12/1989 | Tanase | 15/346 X |

(List continued on next page.)

FOREIGN PATENT DOCUMENTS

| | | | |
|---|---|---|---|
| 0803840A1 | 7/1983 | European Pat. Off. . | |
| 0509353A1 | 10/1992 | European Pat. Off. . | |
| 3316952 | 11/1984 | Germany | 15/346 |
| 4140926A1 | 6/1993 | Germany . | |
| 4143123A1 | 7/1993 | Germany . | |
| 1353376 | 5/1974 | United Kingdom . | |
| 1460276 | 12/1976 | United Kingdom . | |
| 1588348 | 4/1981 | United Kingdom . | |
| 2128680 | 5/1984 | United Kingdom . | |
| 2164378 | 3/1986 | United Kingdom . | |
| 2202884 | 10/1988 | United Kingdom . | |
| 2270334 | 3/1994 | United Kingdom . | |

OTHER PUBLICATIONS

Sep. 1988 Brochure of Elgin Sweeper Company—Elgin Eagle—A new era in four–wheel mechanical street sweeping begins.

*Primary Examiner*—Chris K. Moore
*Attorney, Agent, or Firm*—Leydig, Voit & Mayer, Ltd.

[57] ABSTRACT

A high speed pick-up head for a street sweeper is provided for efficiently removing debris from a roadway surface as the street sweeper moves in a direction of travel. The pick-up head has a width extending in a transverse direction with respect to the direction of travel which defines a path of debris removal along the surface to be cleaned. The pick-up head also includes a structural housing having a top cover portion, a plurality of downwardly extending edge wall portions, a cross-member extending between opposed edge wall portions and disposed at an angle with respect to the transverse direction, and pressure and suction chambers adjacently arranged within the housing and separated by the cross-member. The pressure chamber has a generally circular inlet disposed adjacent to one of the edge wall portions, and a closed bottom portion. The suction chamber has a generally rectangular outlet disposed opposite the inlet of the pressure chamber, and an open bottom disposed adjacent to the surface to be cleaned. The pick-up head further includes a converging-diverging nozzle formed by the cross-member and the closed bottom portion of the pressure chamber for discharging a jet of forced air from the pressure chamber in a direction at least partially towards the outlet of the suction chamber. In use, this jet of forced air advantageously moves debris from the roadway surface in a direction towards the outlet of the suction chamber as the pick-up head moves in the direction of travel.

30 Claims, 7 Drawing Sheets

U.S. PATENT DOCUMENTS

| | | |
|---|---|---|
| 4,903,368 | 2/1990 | Duthie et al. . |
| 4,951,347 | 8/1990 | Star et al. . |
| 5,044,887 | 9/1991 | Duthie et al. . |
| 5,056,615 | 10/1991 | Duthie et al. . |
| 5,072,485 | 12/1991 | Young et al. . |
| 5,113,548 | 5/1992 | Young et al. . |
| 5,173,989 | 12/1992 | Young et al. . |
| 5,337,444 | 8/1994 | Young et al. . |
| 5,363,533 | 11/1994 | Young et al. . |
| 5,560,065 | 10/1996 | Young ..... 15/346 X |

HIGH-SPEED PICK-UP HEAD FOR A STREET SWEEPER

FIELD OF THE INVENTION

The present invention relates generally to street sweepers and, more particularly, to a high speed pick-up head for an industrial street sweeper which efficiently removes debris from a roadway surface with recirculating air flow.

BACKGROUND OF THE INVENTION

Industrial street sweepers are commonly used to remove debris from roadway surfaces such as city streets, parking lots, airport runways, and the like. Such sweepers typically include one or more rotary brushes for dislodging debris from a roadway surface, a vacuum-operated pick-up head for removing dislodged debris, a hopper for collecting debris removed by the pick-up head, and a blower unit for generating a recirculating air flow pattern from the pick-up head, through the hopper, and back through the pick-up head. As the street sweeper passes over the roadway surface, the rotary brushes dislodge and sweep debris into the path of the pick-up head where the recirculating air flow pattern conveys it towards the hopper for collection. After leaving the hopper, the air recirculates back to the pick-up head for further debris removal.

Although air recirculation type street sweepers operate in a generally satisfactory manner, they suffer from some well-known disadvantages including: (1) inefficient and partial removal of relatively heavy debris (e.g., broken glass, gravel, pebbles, and the like) from the roadway surface; (2) substantial aerodynamic losses (i.e., friction and pressure losses); (3) incomplete removal of relatively light debris (e.g., dust, dirt, leaves, paper scraps, and the like) from the recirculating air flow pattern; and (4) a rapid decrease of sweeping performance as the speed of the street sweeper increases.

OBJECTS OF THE INVENTION

Accordingly, a general object of the present invention is to provide a street sweeper which removes debris from a surface in a highly efficient manner.

A further general object of the present invention is to provide a street sweeper which efficiently removes debris from a surface even when the street sweeper is traveling at a relatively high speed.

A more specific object of the present invention is to provide a high-speed pick-up head for an industrial street sweeper which efficiently removes debris from a roadway surface while the street sweeper is traveling at virtually any speed.

A related object of the present invention is to provide a high speed pick-up head for an air recirculation type street sweeper which maximizes debris removal from a roadway surface.

A further object of the present invention is to provide an air recirculation type street sweeper having efficient aerodynamic components.

Another object of the present invention is to provide an air recirculation type street sweeper which recirculates air with minimal aerodynamic losses.

A more specific object of the present invention is to provide a high speed pick-up head for an air recirculation type street sweeper which minimizes pressure losses in the suction outlet of the high-speed pick-up head.

An additional object of the present invention is to provide a high speed pick-up head for an air recirculation type street sweeper which efficiently removes both heavy and light debris from a roadway surface.

Still another object of the present invention is to provide a high speed pick-up head having the foregoing characteristics which is reliable, durable, and convenient to use.

These and other objects, features, and advantages of the present invention will become apparent upon reading the following detailed description of a preferred exemplified embodiment and upon reference to the accompanying drawings.

SUMMARY OF THE INVENTION

The above objects are accomplished by providing a high-speed pick-up head for a street sweeper which efficiently removes debris from a roadway surface as the street sweeper moves in a direction of travel. In particular, the pick-up head has a width extending in a transverse direction with respect to the direction of travel which defines a path of debris removal along the surface to be cleaned. The pick-up head also includes a structural housing having a top cover portion, a plurality of downwardly extending edge wall portions, a cross-member extending between opposed edge wall portions and disposed at an angle with respect to the transverse direction, and pressure and suction chambers adjacently arranged within the housing and separated by the cross-member. The pressure chamber has a generally circular inlet disposed adjacent to one of the edge wall portions, and a closed bottom portion. The suction chamber has a generally rectangular outlet disposed opposite the inlet of the pressure chamber, and an open bottom disposed adjacent to the surface to be cleaned. The pick-up head further includes a converging-diverging nozzle formed by the cross-member and the closed bottom portion of the pressure chamber for discharging a jet of forced air from the pressure chamber in a direction at least partially towards the outlet of the suction chamber. In use, this jet of forced air advantageously moves debris from the roadway surface in a direction towards the outlet of the suction chamber as the pick-up head moves in the direction of travel. A deflector plate is also provided for diverting debris towards the outlet of the suction chamber. The deflector plate is mounted to one of the edge wall portions of the housing and is disposed adjacent to the outlet of the suction chamber.

BRIEF DESCRIPTION OF THE DRAWINGS

In the drawings, wherein similar reference numerals denote similar elements throughout the several views.

While the present invention will be described and disclosed in connection with certain preferred embodiments and procedures, the intent is not to limit the present invention to these specific embodiments. On the contrary, the intent is to cover all such alternatives, modifications, and equivalents that fall within the spirit and scope of the present invention as defined by the appended claims.

DETAILED DESCRIPTION OF THE PREFERRED EMBODIMENT

Figure 1:
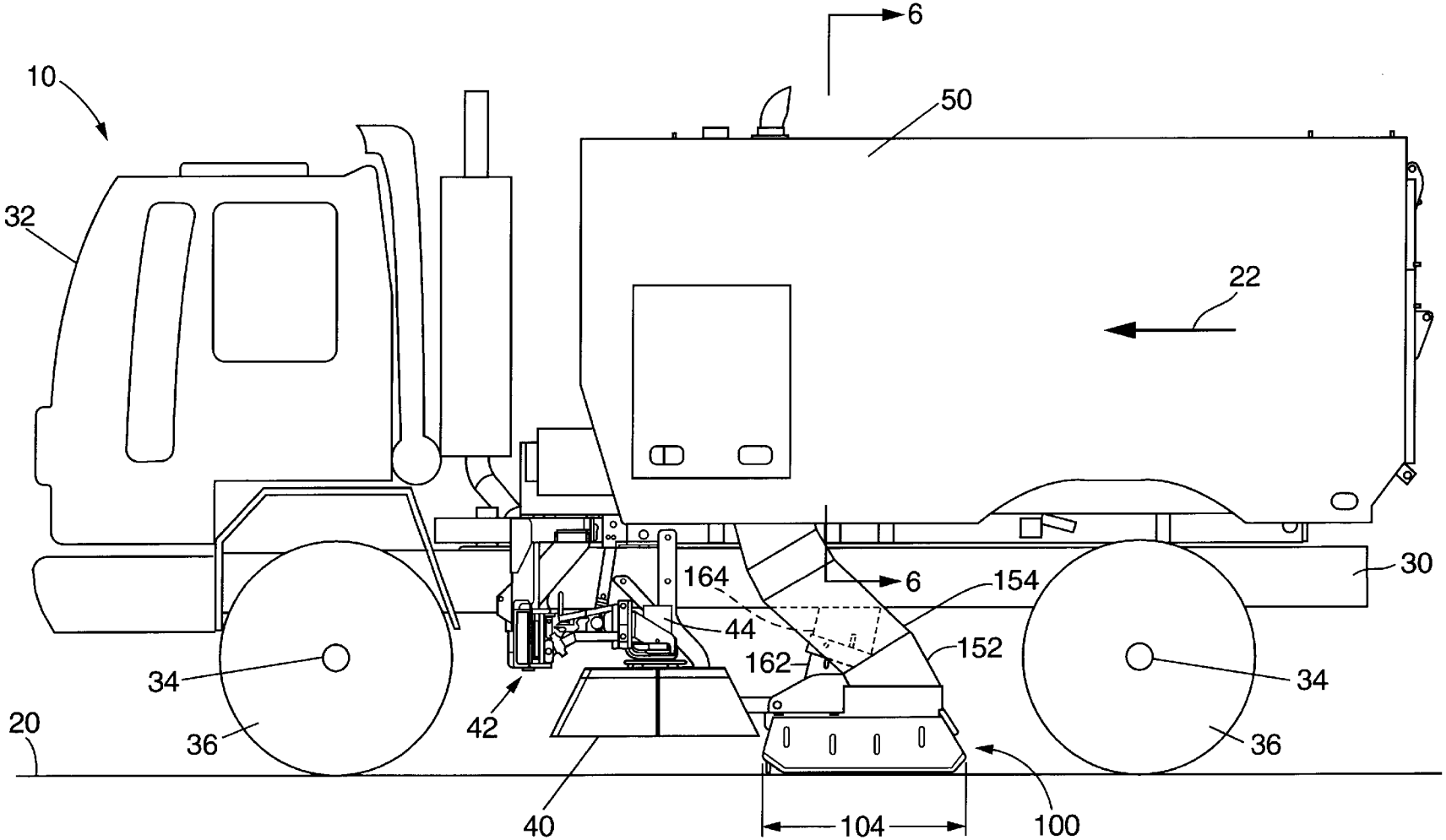
FIG. 1 is a side elevational view of a street sweeper having a high speed pick-up head in accordance with the present invention.

Turning now to the drawings, a high speed pick-up head constructed in accordance with the present invention is generally designated by reference numeral 100. As best shown in FIG. 1, the pick-up head 100 is specifically adapted to be mounted to an industrial street sweeper 10 in close proximity to a roadway surface 20 such as a street, a parking lot, an airport runway, or the like. As is customary in the art, the street sweeper 10 includes a standard truck chassis 30 which carries a cab 32, front and rear axles 34 with associated wheels 36, rotary brushes 40 disposed between the axles 34, a collection hopper 50, and a blower unit or air suction pump (not shown) for generating a recirculating air flow pattern which repeatedly cycles from the pick-up head 100, through the collection hopper 50, and back to the pick-up head 100. As the sweeper 10 moves in a direction of travel designated generally by reference numeral 22, the rotary brushes 40 dislodge and sweep debris (e.g., dirt, leaves, gravel, rocks, scraps of paper, and the like) from the surface 20 to be cleaned and into the path of the pick-up head 100 where the recirculating air flow pattern conveys the dislodged debris towards the hopper 50 for collection.

As shown in FIG. 1, the rotary brushes 40 are pivotally attached to the truck chassis 30 via a brush linkage assembly 42 which conveniently moves the brushes 40 between a raised position and a lowered position. In the raised position, the brushes 40 are spaced apart from the roadway surface 20, as shown in FIG. 1, and in the lowered position, the brushes 40 are in direct communication with the roadway surface 20 (not shown). When the sweeper 10 is cleaning the roadway surface 20, the brushes 40 are preferably in the lowered position. When the sweeper 10 is in transit between cleaning sites, however, the brushes 40 are preferably in the raised position so as to prevent harmful contact with the roadway surface 20. A hydraulic motor 44 is also provided for selectively rotating each brush 40.

Figure 2:
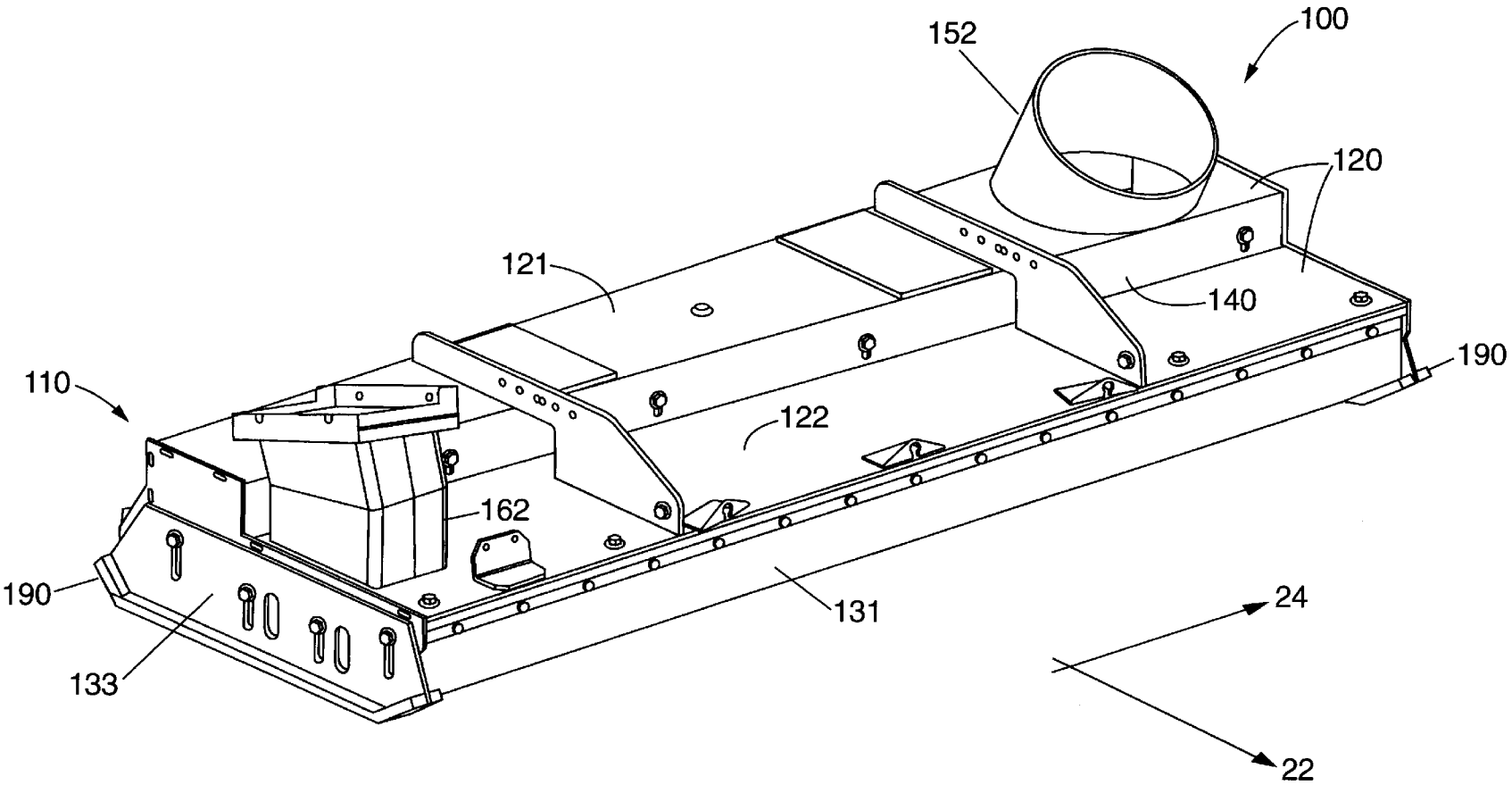
FIG. 2 is a perspective view of the high-speed pick-up head depicted in FIG. 1.
Figure 3:
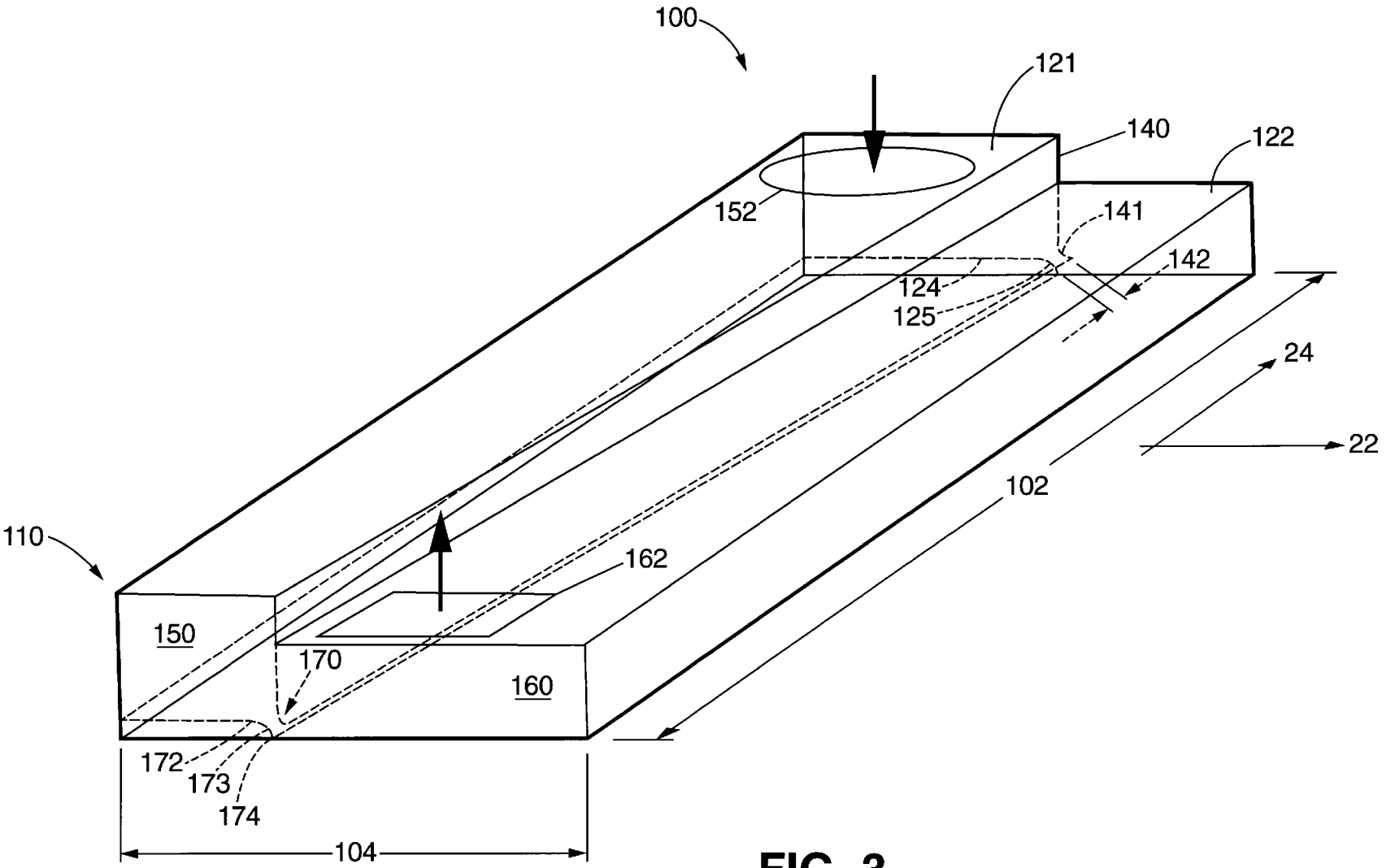
FIG. 3 is a schematic perspective view of the high-speed pick-up head depicted in FIG. 2, showing an exemplary air flow pattern therethrough.
Figure 4:
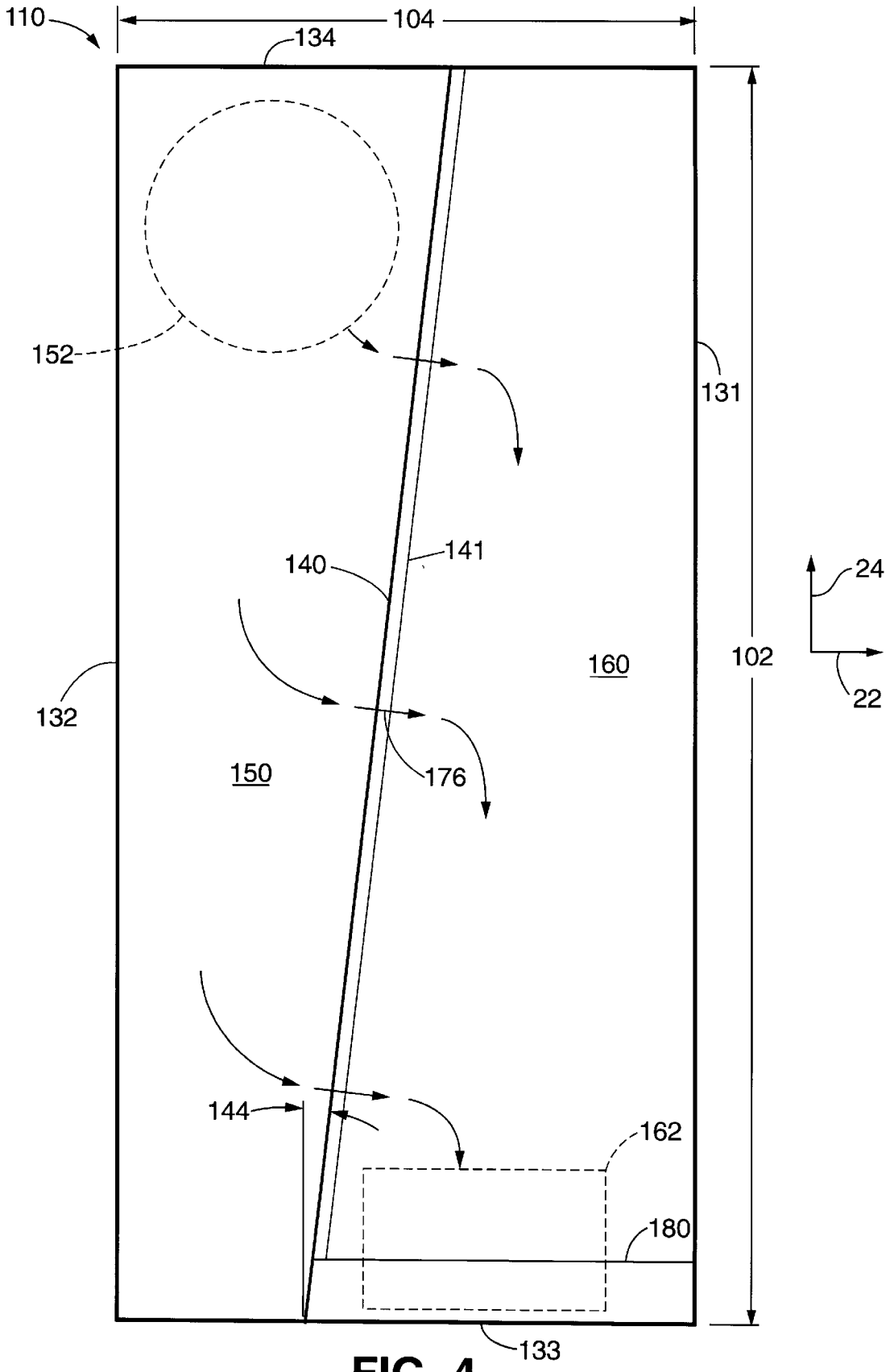
FIG. 4 is a top plan schematic view of the high speed pick-up head shown in FIG. 3, with the top cover portion removed in order to more clearly show the cross-member separating the pressure and suction chambers.

As shown in FIGS. 2–4, the high speed pick-up head 100 of the present invention is generally box-like or rectangular in configuration, with an associated width 102 and length 104. When the pick-up head 100 is assembled to the street sweeper 10, the width 102 is generally parallel to the axles 34 of the sweeper 10 and extends in a generally transverse direction 24 with respect to the direction of travel 22. The length 104, in contrast, is generally perpendicular to the axles 34 of the sweeper 10 and extends in a generally parallel direction with respect to the direction of travel 22. In this way, the width 102 of the pick-up head 100 defines a path of debris removal along the surface 20 to be cleaned when the sweeper 10 moves along the direction of travel 22.

In the illustrated embodiment, the pick-up head 100 includes a housing or frame 110 which encloses an air pressure chamber 150 and an air suction chamber 160 in side-by-side adjacent relationship. As shown in FIGS. 2–4, the housing 110 includes a closed top cover portion 120 having first and second panels 121 and 122 which cover the air pressure chamber 150 and the air suction chamber 160, respectively. Enclosing the housing 110 on all four sides are edge wall portions 131–134 which extend downwardly from the top cover portion 120. In particular, a front edge wall 131 extends downwardly from the front of the second panel 122 of the top cover portion 120, a rear edge wall 132 extends downwardly from the rear of the first panel 121 of the top cover portion 120, and opposed first and second side walls 133 and 134 extend downwardly from the sides of the top cover portion 120 and interconnect the front and rear edge walls 131 and 132 to form the generally rectangular frame 110. The air pressure and air suction chambers 150 and 160 are separated within the housing 110 by a cross-member 140 which extends downwardly between the two panels 121 and 122 of the top cover portion 120. In addition, a bottom panel 124 extends substantially between the rear edge wall 132 and the cross-member 140 to provide the air pressure chamber 150 with a closed bottom portion or surface. The air suction chamber 160, in contrast, has an open bottom portion which provides access to debris on the roadway surface 20.

Due to this construction, the pressure chamber 150 is bounded on all six sides including the bottom, while the suction chamber 160 is only bounded on five sides with the bottom being open. More specifically, the pressure chamber 150 is defined by: (1) the first panel 121 of the top cover portion 120; (2) the rear edge wall 132; (3) the first side wall 133; (4) the second side wall 134; (5) the cross-member 140; and (6) the bottom panel 124. The suction chamber 160, in contrast, is defined by: (1) the second panel 122 of the top cover portion 120; (2) the front edge wall 131; (3) the first side wall 133; (4) the second side wall 134; and (5) the cross-member 140. In order to provide sufficient toughness and durability to the pick-up head 100, all of its structural components are preferably formed of a high-strength material such as steel.

As shown diagramatically in FIG. 3, a nozzle or blast orifice 170 is formed between the pressure and suction chambers 150 and 160 by a small gap 142 between the cross-member 140 and the bottom panel 124 of the housing 110. In operation, this nozzle 170 discharges a jet of forced air 176 in a direction from the pressure chamber 150 towards the suction chamber 160 when a pressure differential exists therebetween. In the illustrated embodiment, both the cross-member 140 and the bottom panel 124 have rounded edge portions 141 and 125 which provide the nozzle 170 with a converging-diverging configuration. More specifically, the nozzle 170 includes a converging portion 172 on the pressure side 150, a diverging portion 174 on the suction side 160, and a throat 173 therebetween. In use, the converging-diverging shape of the nozzle 170 advantageously minimizes aerodynamic losses within the pick-up head 100 and maximizes the velocity of the jet of forced air 176 at the throat 173 of the nozzle 170. The converging-diverging nozzle 170 is also inclined in a downwardly direction in order to dislodge or blast debris from the roadway surface 20.

In accordance with an important aspect of the present invention, the cross-member 140 and the associated nozzle 170 are disposed at an angle 144 with respect to the transverse direction 24, as shown in FIG. 4. Because of this arrangement, the jet of forced air 176 exiting through nozzle 170 is directed substantially perpendicular to the cross-member 140 and partially towards the outlet 162 of the suction chamber 160. Put another way, the jet of forced air 176 includes a vector component which is parallel to the transverse direction 24. In operation, this advantageous nozzle 170 arrangement causes the jet of forced air 176 to efficiently move debris from the roadway surface 20 in a direction towards the outlet 162 of the suction chamber 160 as the pick-up head 100 moves in the direction of travel 22.

As best shown in FIG. 2, the pressure chamber 150 of the housing 110 includes a generally circular inlet 152 through which air is supplied, and suction chamber 160 includes an outlet 162 through which air and debris from the roadway surface 12 are evacuated. Of course, the inlet 152 of the pressure chamber 150 is adapted to be connected to a source of positive air pressure (e.g., the high pressure side of the blower unit), while the outlet 162 of the suction chamber 160 is adapted to be connected to a source of negative air pressure (e.g., the low pressure side of the blower unit). In the illustrated embodiment, the inlet 152 of the pressure chamber 150 is formed in the first panel 121 of the top cover portion 120 and is adjacent to the rear edge wall 133 and the second side wall 134 of the housing 110. The outlet 162 of the suction chamber 160, in contrast, is formed in the second panel 122 of the top cover portion 120 and is adjacent to the front edge wall 131 and the first side wall 133 of the housing 110. In this way, the inlet 152 of the pressure chamber 150 and the outlet 162 of the suction chamber 160 are disposed at opposite corners of the housing 110.

The tapered configuration of the pressure and suction chambers 150 and 160 supplied by the angled cross-member 140 also provides a pressure stabilization feature which makes localized pressure levels within the pressure chamber 150 substantially uniform along the entire width 102 of the pick-up head 100. More specifically, this pressure stabilization feature helps prevent relatively high localized pressures in the vicinity of the inlet 152 (where air mass flow is relatively high) and relatively low localized pressures away from the inlet 152 (e.g., near the first side wall 133 of the pressure chamber 150) (where air mass flow is relatively low). Indeed, because of this pressure stabilization feature, localized pressure levels are substantially uniform throughout the pressure chamber 150. This, in turn, causes a substantially uniform pressure differential along the full span of the nozzle 170.

As shown in FIG. 1, the inlet 152 of the pressure chamber 150 is connected to the hopper 50 via a pressure tube 154, and the outlet 162 of the suction chamber 160 is connected to the hopper 50 via a suction tube 164. In addition, the open bottom portion 126 of the suction chamber 160 is closed by the roadway surface 20. In this way, a substantially enclosed loop is formed between the pressure chamber 150, the nozzle 170, the bounded suction chamber 160, the outlet 162 of the suction chamber 160, the suction tube 164, the collection hopper 50, the pressure tube 154, and the inlet 152 of the pressure chamber 150.

When the blower unit is activated or energized, this loop defines the recirculating air flow pattern for the street sweeper 10 and the attached pick-up head 100. More specifically, the blower unit creates a vacuum in the suction chamber 160 which draws air in through the nozzle 170 and creates the jet of forced air 176 between the pressure and suction chambers 150 and 160. This, in turn, causes air (and debris from the roadway surface 20) to exit through the outlet 162 of the suction chamber 160. After flowing through the suction tube 164, air and debris enters the collection hopper 50 where the debris is deposited and the air is de-contaminated. Thereafter, substantially cleaner air is returned to pressure tube 154 by the blower unit.

As shown in FIGS. 2–4, the outlet 162 of the suction chamber 160 is generally rectangular in configuration and is arranged along the first side wall 133 of the housing 110. This advantageous outlet arrangement maximizes debris removal from the roadway surface 20 by providing substantially complete coverage and maximizing outlet area along the first side wall 133 of the suction chamber 160. Such coverage prevents laterally moving debris from flying past or over-shooting the outlet 162, as with prior art circular outlets, thereby enabling the outlet 162 to collect and capture debris in a highly efficient manner.

Figure 7:
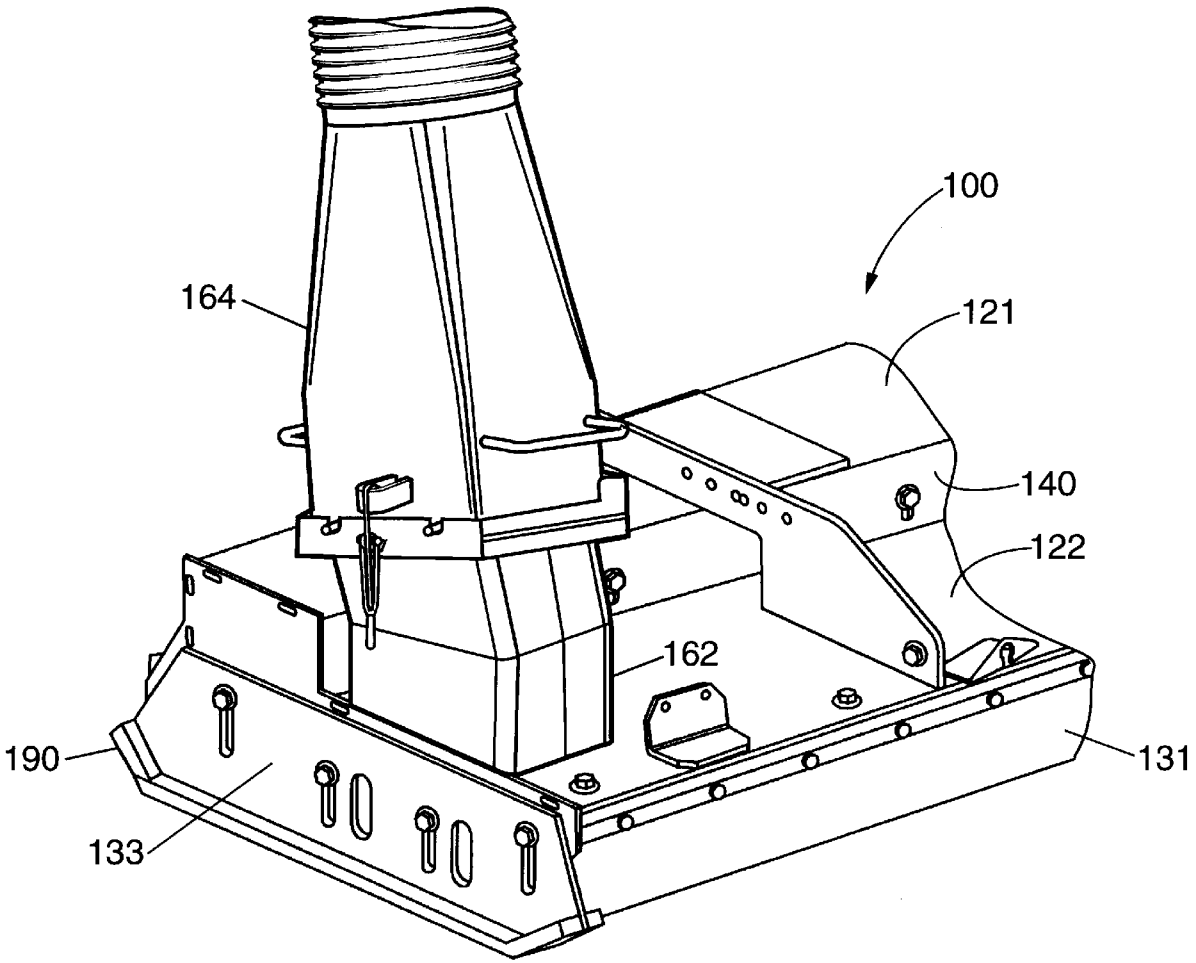
FIG. 7 is an enlarged perspective view of the high-speed pick-up head depicted in FIG. 2, showing a transitioning suction tube attached to the outlet of the suction chamber.

As best shown in FIG. 7, the suction tube 164 transitions from a generally rectangular configuration at the outlet 162 of the suction chamber 160 to a generally circular configuration. The suction tube 164 also has a substantially constant cross-sectional area which provides a substantially constant air flow velocity therethrough, and a smooth internal surface which minimizes aerodynamic losses.

Figure 5:
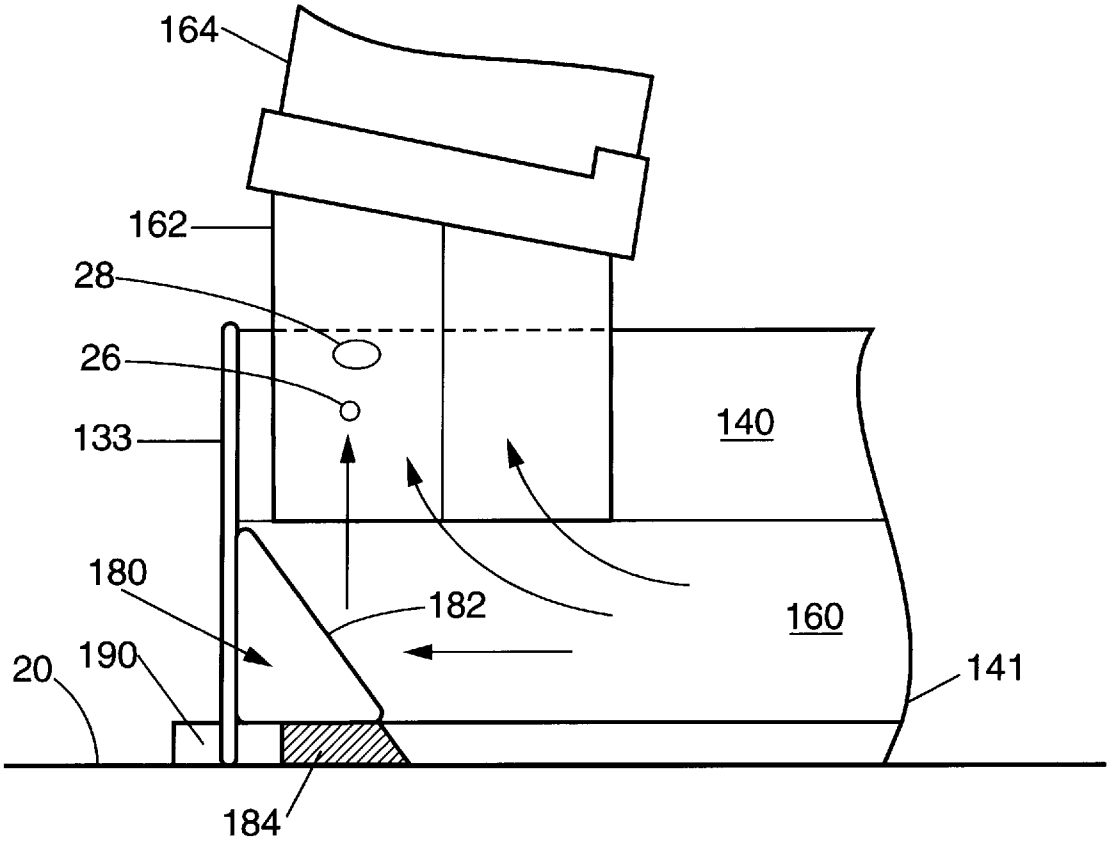
FIG. 5 is a partially fragmentary side elevational view of high-speed pick-up head depicted in FIG. 2, showing a deflector plate disposed near the outlet of the suction chamber.

In keeping with another important aspect of the present invention, a deflector plate 180 is arranged within the suction chamber 160 for diverting both relatively light debris 26 (e.g., dust, dirt, leaves, paper scraps, and the like) and relatively heavy debris 28 (e.g., broken glass, gravel, pebbles, and the like) towards the outlet 162 of the suction chamber 160. As shown in FIG. 5, the deflector plate 180 is generally triangular in configuration, is mounted to the first side wall 133 of the housing 110, and is arranged adjacent to the generally rectangular outlet 162 of the suction chamber 160. In addition, the deflector plate 180 includes a generally flat debris-contact surface 182, and a resilient wear element 184 attached to the underside thereof. Because this wear element 184 is configured to rub against the roadway surface 20, the deflector plate 180 spans substantially the full height of the suction chamber 160. As shown in FIG. 5, debris moves laterally across the suction chamber 160 in a direction towards the outlet 162, strikes the debris-contact surface 182 of the deflector plate 210, and advantageously deflects upwardly into the suction tube 164. Like the other components which make-up the housing 110, the debris-contact surface 182 portion of the deflector plate 180 is preferably formed of a tough, durable, and high-strength material such as steel. The wear element 184, however, is preferably formed of wear resistant material such as rubber. In addition, although a flat debris-contact surface 182 has been specifically described and illustrated herein, it will be readily appreciated by those skilled in the art that an arcuate debris-contact surface or other configuration may alternatively be used.

In order to prevent excessive wear and damage to the pick-up head 100 while the sweeper 10 is in transit, skid plate members 190 are attached to the first and second side walls 133 and 134 of the housing 110, as shown in FIG. 1. Since the skid plate members 190 rub against the roadway surface 20, they are preferably formed of a high-strength material such as steel and include a carbide insert which reduces wear and spark formation.

Figure 6:
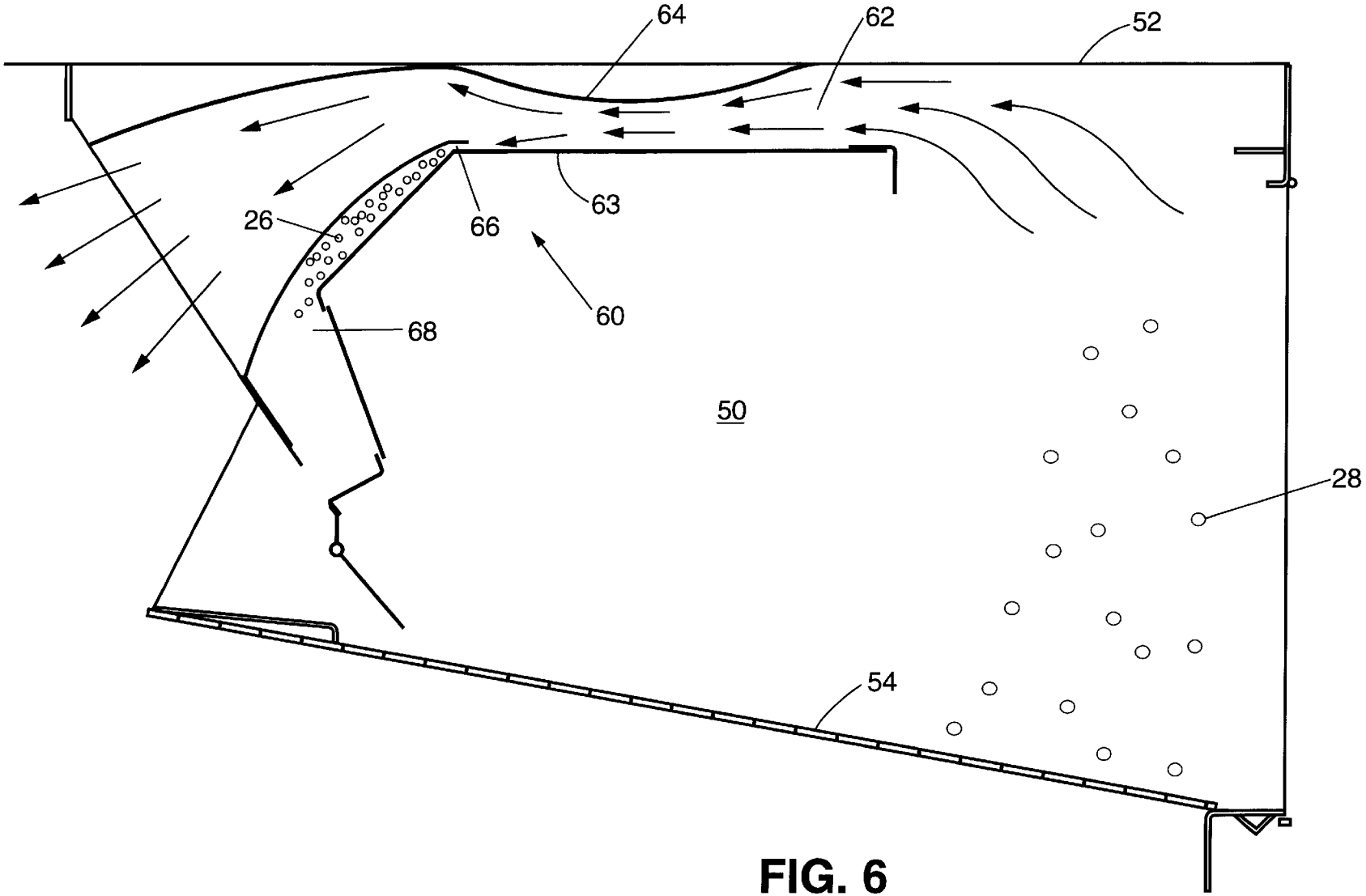
FIG. 6 is a cross-sectional view taken substantially along line 6—6 of FIG. 1, showing a debris separation system disposed within the hopper of the street sweeper.

In keeping with an important aspect of the present invention, a debris separation system 60 is disposed within the collection hopper 50 for removing relatively light debris 26 from the recirculating air flow pattern, as shown, for example, in FIG. 6. Unlike relatively heavy debris 28 which is carried into the hopper 50 by the recirculating air flow pattern but falls to the bottom portion 54 of the hopper 50 due to the influence of gravity, relatively light debris 26 must be extracted or removed from the recirculating air flow pattern in some way. Indeed, if relatively light debris 26 is not removed from the recirculating air flow pattern, it may continuously cycle through the hopper 50, the pressure tube 154, the pick-up head 100, and the suction tube 164, respectively.

As shown in FIG. 6, the debris separation system 60 of the present invention includes a duct 62 disposed adjacent to the top portion 52 of the hopper 50 and along the recirculating air flow pattern. The debris separation system 60 also includes a generally arcuate re-direction member 64 disposed within the duct 62 for guiding relatively light debris 26 into a slot 66 formed on the bottom side 63 of the duct 62. Once intercepted by the slot 66, the relatively light debris 26 advantageously falls into a chute 68 disposed adjacent to the slot 66 which leads to the bottom portion 54 of the hopper 50.

While the present invention has been described and disclosed with an emphasis upon a preferred embodiment, it will be understood, of course, that the present invention is not strictly limited thereto. Since modifications may be made to the structures disclosed herein—particularly in light of the foregoing teachings—without departing from the present invention, the following claims are intended to cover all structures that fall within the scope and spirit of the present invention.

What is claimed is:

1. A pick-up head for removing debris from a surface as the pick-up head moves in a direction of travel, the pick-up head having a width extending in a transverse direction with respect to the direction of travel and defining a path of debris removal along the surface to be cleaned, the pick-up head comprising:

a housing including a top cover portion, a plurality of downwardly extending edge wall portions, and pressure and suction chambers adjacently arranged within the edge wall portions, the pressure chamber being separated from the suction chamber by a cross-member extending between opposed edge wall portions and disposed at an angle with respect to the transverse direction, the pressure chamber including an inlet and a closed bottom portion, the inlet of the pressure chamber disposed adjacent to one of the edge wall portions and adapted to be connected to a source of positive air pressure, the suction chamber including an outlet and an open bottom disposed adjacent to the surface to be cleaned, the outlet of the suction chamber disposed opposite the inlet of the pressure chamber and adapted to be connected to a source of negative air pressure; and a nozzle disposed between the pressure and suction chambers of the housing and arranged along the cross-member for discharging a jet of forced air from the pressure chamber to the suction chamber in a direction at least partially towards the outlet of the suction chamber.

2. The pick-up head set forth in claim 1, wherein the pressure chamber has a tapered configuration which narrows in a direction from the edge wall portion disposed adjacent to the inlet to the opposed edge wall portion, the tapered configuration of the pressure chamber providing substantially uniform localized pressure levels along the entire width of the pick-up head.

3. The pick-up head set forth in claim 1, wherein the outlet of the suction chamber is generally rectangular in configuration.

4. The pick-up head set forth in claim 1, wherein a suction tube is attached to the outlet of the suction chamber, the suction tube transitioning from a generally rectangular configuration to a generally circular configuration.

5. The pick-up head set forth in claim 4, wherein the suction tube has a substantially smooth internal surface.

6. The pick-up head set forth in claim 4, wherein the suction tube has a substantially constant cross-sectional area which provides a substantially constant air flow velocity therethrough.

7. The pick-up head set forth in claim 1, wherein the nozzle includes a converging portion and a diverging portion disposed downstream of the converging portion.

8. The pick-up head set forth in claim 1, further comprising a deflector plate disposed within the suction chamber for diverting debris towards the outlet of the suction chamber.

9. The pick-up head set forth in claim 8, wherein the deflector plate is mounted to one of the edge wall portions of the housing and is disposed adjacent to the outlet of the suction chamber.

10. The pick-up head set forth in claim 8, wherein the deflector plate includes a generally flat debris-contact surface.

11. The pick-up head set forth in claim 10, wherein the deflector plate includes a wear element attached to the underside thereof.

12. The pick-up head set forth in claim 1, further comprising skid plate members attached to at least two of the edge wall portions of the housing.

13. The pick-up head set forth in claim 12, wherein the skid plate members are formed of steel and include carbide inserts.

14. A pick-up head for removing debris from a surface as it moves in a direction of travel, the pick-up head having a width extending in a transverse direction with respect to the direction of travel and defining a path of debris removal along the surface to be cleaned, the pick-up head comprising:

a housing having a closed top portion and a plurality of edge wall portions extending downwardly from the top portion;

an air pressure chamber and an air suction chamber adjacently disposed within the housing and separated by a cross-member, the cross-member extending between opposed edge wall portions of the housing and disposed at an angle with respect to the transverse direction, the air pressure chamber defined by the top portion, at least three of the edge wall portions, the cross-member, and a closed bottom portion, the air suction chamber defined by the top portion, at least three of the edge wall portions, and the cross-member, the air pressure chamber including an inlet for supplying pressurized air thereto, the air suction chamber including an open bottom portion disposed adjacent to the surface to be cleaned and an outlet through which air and debris are evacuated; and a nozzle formed by the cross-member and the bottom portion of the pressure chamber for discharging a jet of forced air from the air pressure chamber to the air suction chamber, the jet of forced air including a vector component parallel to the transverse direction which urges debris towards the outlet of the air suction chamber as the pick-up head moves in the direction of travel.

15. The pick-up head set forth in claim 14, wherein the pressure chamber has a tapered configuration which narrows in a direction from the edge wall portion disposed adjacent to the inlet to the opposed edge wall portion, the tapered configuration of the pressure chamber providing substantially uniform localized pressure levels along the entire width of the pick-up head.

16. The pick-up head set forth in claim 14, wherein the outlet of the air suction chamber is generally rectangular in configuration.

17. The pick-up head set forth in claim 14, wherein the outlet of the air suction chamber transitions from a generally rectangular configuration to a generally circular configuration.

18. The pick-up head set forth in claim 17, wherein the transitioning outlet of the air suction chamber has a substantially smooth internal surface.

19. The pick-up head set forth in claim 17, wherein the transitioning outlet of the air suction chamber has a substantially constant cross-sectional area which provides a substantially constant air flow velocity therethrough.

20. The pick-up head set forth in claim 14, wherein the nozzle includes a converging portion, a throat, and a diverging portion.

21. The pick-up head set forth in claim 14, further comprising a deflector plate disposed adjacent to the outlet of the air suction chamber and mounted to one of the edge wall portions of the housing for diverting debris towards the outlet of the air suction chamber.

22. A pick-up head for removing debris from a surface as the pick-up head moves in a direction of travel, the pick-up head having a width extending in a transverse direction with respect to the direction of travel and defining a path of debris removal along the surface to be cleaned, the pick-up head comprising:

a frame having a front edge wall, a rear edge wall, and opposed side walls interconnecting the front and rear edge walls;

an air pressure chamber disposed within the frame and defined by the rear edge wall, the opposed side walls, a cross-member extending between the opposed side walls and disposed at an angle with respect to the transverse direction, a first top panel extending between the rear edge wall and the cross-member, and a bottom panel extending from the rear edge wall in a direction towards the cross-member, the air pressure chamber having an inlet through which pressurized air is supplied, the inlet disposed adjacent to one of the side walls of the frame;

an air suction chamber disposed within the frame in side-by-side adjacent relationship with respect to the air pressure chamber and defined by the front edge wall, the opposed side walls, the cross-member, and a second top panel extending between the front edge wall and the cross-member, the air suction chamber having an open bottom portion disposed adjacent to the surface to be cleaned and an outlet through which air and debris are evacuated as the pick-up head moves in the direction of travel, the outlet of the air suction chamber disposed opposite of the inlet of the air pressure chamber; and a nozzle formed by the cross-member and the bottom plate of the pressure chamber for discharging a jet of forced air from the air pressure chamber to the air suction chamber in a direction substantially perpendicular to the cross member, the jet of forced air moving debris from the surface to be cleaned towards the outlet of the air suction chamber as the pick-up head moves in the direction of travel.

23. The pick-up head set forth in claim 22, wherein the outlet of the air suction chamber is generally rectangular in configuration.

24. The pick-up head set forth in claim 22, wherein a suction tube is attached to the outlet of the suction chamber, the suction tube transitioning from a generally rectangular configuration to a generally circular configuration.

25. The pick-up head set forth in claim 24, wherein the suction tube has a substantially smooth internal surface.

26. The pick-up head set forth in claim 24, wherein the suction tube has a substantially constant cross-sectional area which provides a substantially constant air flow velocity therethrough.

27. The pick-up head set forth in claim 22, wherein the nozzle includes a converging portion, a diverging portion disposed downstream of the converging portion, and a throat portion disposed between the converging portion and the diverging portion.

28. The pick-up head set forth in claim 22, further comprising a deflector plate disposed adjacent to the outlet of the air suction chamber and mounted to one of the opposed side walls of the frame for diverting debris towards the outlet of the air suction chamber.

29. A sweeper for removing debris from a surface to be cleaned, the sweeper comprising:

a vehicle including a chassis;

a pick-up head mounted to the chassis of the vehicle and arranged substantially adjacent to the surface to be cleaned, the pick-up head removing debris from the surface as the sweeper moves in a direction of travel, the pick-up head having a width extending in a transverse direction with respect to the direction of travel and defining a path of debris removal along the surface, the pick-up head including a housing having a closed top portion, a plurality of edge wall portions extending downwardly from the top portion, pressure and suction chambers adjacently arranged within the housing and separated by a cross-member extending between opposed edge wall portions and disposed at an angle with respect to the transverse direction, and a nozzle formed by the cross-member and a bottom portion of the pressure chamber for discharging a jet of forced air from the pressure chamber to the suction chamber, the pressure chamber including an inlet for supplying pressurized air thereto, the suction chamber including an open bottom portion disposed adjacent to the surface to be cleaned and an outlet through which air and debris are evacuated, the jet of forced air including a vector component parallel to the transverse direction which moves debris towards the outlet of the suction chamber as the pick-up head moves in the direction of travel;

a hopper mounted to the chassis for collecting debris removed by the pick-up head, the hopper being connected to the outlet of the suction chamber and to the inlet of the pressure chamber;

a blower unit for generating a substantially recirculating air flow pattern through the outlet of the suction chamber, through the hopper, through the inlet of the pressure chamber, through the nozzle, and back through the outlet of the suction chamber; and a debris separation system disposed within the hopper for separating relatively light debris from the recirculating air flow pattern.

30. The sweeper set forth in claim 29, wherein the debris separation system includes a duct disposed at least partially along the recirculating air flow pattern, a re-direction member disposed within the duct for directing relatively light debris towards a side of the duct, a slot disposed on the side of the duct for intercepting relatively light debris from the re-direction member, and a chute disposed adjacent to the slot in the duct for allowing relatively light debris to fall towards a bottom portion of the hopper.

* * * * *